US007293295B2

(12) United States Patent
King

(10) Patent No.: US 7,293,295 B2
(45) Date of Patent: Nov. 13, 2007

(54) MEDICAL SUPPORT ASSEMBLY GARMENT

(75) Inventor: Joy J. King, Lake Forest, CA (US)

(73) Assignee: 2 Assist, LLC, Lake Forest, CA (US)

( * ) Notice: Subject to any disclaimer, the term of this patent is extended or adjusted under 35 U.S.C. 154(b) by 0 days.

(21) Appl. No.: 11/284,525

(22) Filed: Nov. 21, 2005

(65) Prior Publication Data

US 2007/0113316 A1 May 24, 2007

(51) Int. Cl.
*A41D 1/04* (2006.01)

(52) U.S. Cl. ..... 2/114; 2/102

(58) Field of Classification Search ..... 2/77, 2/113–115, 82, 102, 103, 462, 48–51, 247–245
See application file for complete search history.

(56) References Cited

U.S. PATENT DOCUMENTS 4,602,390 A * 7/1986 Morera et al. ..... 2/251
4,698,848 A * 10/1987 Buckley ..... 2/114
4,718,124 A * 1/1988 Sawicki et al. ..... 2/114
5,031,244 A * 7/1991 Inagaki ..... 2/102
5,054,127 A * 10/1991 Zevchak ..... 2/247
5,142,702 A * 9/1992 Piloian ..... 2/102
5,375,265 A * 12/1994 Selzer ..... 2/242
5,429,593 A * 7/1995 Matory ..... 602/79
5,991,923 A * 11/1999 Maria ..... 2/83
6,233,747 B1 * 5/2001 Barker ..... 2/247
6,397,398 B1 * 6/2002 Herder ..... 2/249
6,574,800 B1 * 6/2003 Leger et al. ..... 2/114
6,647,552 B1 * 11/2003 Hogan ..... 2/114
6,763,527 B1 * 7/2004 Rivoli et al. ..... 2/250
2004/0226073 A1 * 11/2004 McCullar et al. ..... 2/114
2006/0037124 A1 * 2/2006 Cho et al. ..... 2/114
2006/0085890 A1 * 4/2006 Beuk ..... 2/114

OTHER PUBLICATIONS

Imaginis.com Breast Health News. http://imaginis.com/breasthealth/news/news1.13.00.asp?mode=1 Jan. 13, 2000.
Crinkelmeyer, Sandi, Transition Gown. http://www.assistwear.com/gown.htm 2004-2005.

* cited by examiner

*Primary Examiner*—Alissa Hoey
(74) *Attorney, Agent, or Firm*—Blakely, Sokoloff, Taylor & Zafman LLP

(57) ABSTRACT

A medical support assembly garment dimensionally adapted to receive a torso of a patient. The garment includes a vest portion including a back portion, and a left front portion and a right front portion each extending from opposite ends of the back portion and each comprising an inner surface facing the torso, and at least one pocket attached to the inner surface of at least one of the left and the right portions, wherein the pocket is adapted to support at least one container for storing bodily fluid outputted from the patient.

6 Claims, 3 Drawing Sheets

MEDICAL SUPPORT ASSEMBLY GARMENT

FIELD OF THE INVENTION

This invention relates to medical devices. More particularly, the present invention is directed to medical support garments.

BACKGROUND OF THE INVENTION

Attachment of external drainage devices to a patient's body, such as following a surgery, are common place for a variety of surgical procedures in wide-spread use today.

One area in which these external drainage devices are often attached to patients following a surgery is the operations performed on a patient's breast(s) such as those performed in treatment of breast cancer. Most commonly, breast cancer operations include mastectomy which involve removal of the breast, or lumpectomy which involve removal of lumps from the breast, and often include, or are followed by, some form of breast reconstruction surgery. Following these surgeries, the operating physician often inserts a drainage tube near the operated areas of the patient's breast to reduce accumulations of post-operative fluids, such as blood or lymph, during the convalescence period. The tubes are typically not removed until the drainage output falls to below a predetermined volume per day, such as to below 30 ccs (1 fluid oz).

Generally, these external tubes, often made of rubber or plastic, are secured at one end to patient's body only by sutures. The other end of the tube is typically connected to a reservoir or container in which the fluids are received and collected. As such, movements of the tubes can cause tugging or even tearing of the connecting sutures resulting in pain, discomfort or serious injury to the patient. In addition, the container's weight and swing motion often exerts detrimental force on the tubes to further exacerbate the foregoing problems.

To reduce the adverse impacts of the movement or weight of the container on the tubes, patients are often required to restrain the container from movement. One approach is for the patients to hold the container by hand, which reduces the availability of their hands for every day usage. Other approaches include the securing of the container or the tubes to the patient's clothing or hospital gown, such as via a pin. A shortcoming in the foregoing approaches is that the container and large portions of the tubes remain exposed and prone to impact or entanglements with external objects in the patient's path, such as door knobs, handles or other protruding objects, thus still resulting in tugging or tearing of the connecting sutures. In addition, during activities which require both the removal of a patient's garments and the use of patient's hands, such as showering, the patients are often forced to once again resort to holding the container in their hand(s) which they need for showering and safeguarding against slippage, thus often increasing the chances of shower-related injuries to the patient.

Accordingly, there is a need for providing improved mobility and reduced inconveniences to patients with externally attached drainage devices during both day and night recovery period, and bathing activities.

SUMMARY OF THE INVENTION

This invention can be regarded as a medical support assembly garment dimensionally adapted to receive a torso of a patient. The garment includes a vest portion including a back portion, and a left front portion and a right front portion each extending from opposite ends of the back portion and each comprising an inner surface facing the torso, and at least one pocket attached to the inner surface of at least one of the left and the right portions, wherein the pocket is adapted to support at least one container for storing bodily fluid outputted from the patient.

This invention can also be regarded as a medical support assembly garment dimensionally adapted to receive a torso of a patient. The garment includes a vest portion including a back portion, and a left front portion and a right front portion each extending from opposite ends of the back portion and each comprising an inner surface facing the torso, and a retaining belt assembly attached to the vest and comprising a first end and a second end, wherein the first and second ends are adapted to circumscribe the torso and to attached to each other to retain the torso within the vest. The garment further includes at least one pocket attached to the inner surface of at least one of the left and the right portions and comprising means for opening and closing of the pocket, wherein the pocket is adapted to support at least one container for storing bodily fluid outputted from the patient, the container comprising a drain tube attached to the container adapted to transfer the bodily fluid outputted from the patient to the container, wherein the vest comprises at least one tab portion adapted to be attached to by the container for restricting a movement of the container, and wherein the pocket comprises the tab portion for restricting a movement of at least one of the drain tube and the container in the pocket.

DETAILED DESCRIPTION OF THE INVENTION

Figure 1:
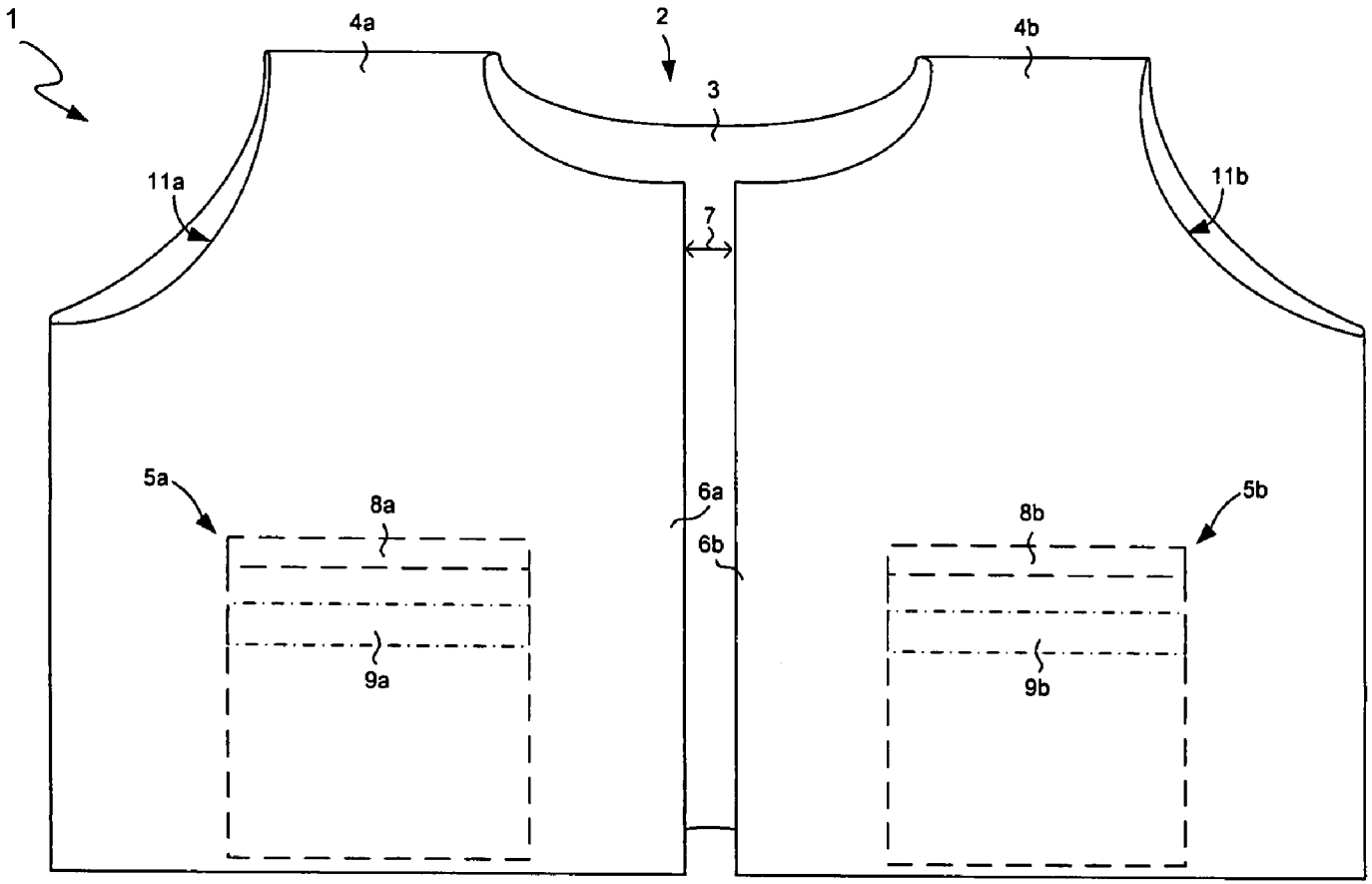
FIG. 1 is a front view of an embodiment of the medical support assembly garment of the present invention.

With reference to FIG. 1, an embodiment of the medical support assembly garment 1 of the present invention is shown. The medical support assembly garment 1, such as a post-operative support garment, is dimensionally adapted to receive a torso of a patient (not shown). The medical support assembly garment 1 includes a vest portion 2 including a back portion 3. As shown in FIG. 1, the vest portion 2 further includes a left front portion 4*a* and a right front portion 4*b*, each extending from opposite ends of the back portion 3. Each of the left front portion 4*a* and the right front portion 4*b* includes an inner surface facing the torso, such as inner surfaces 11*a* and 11*b* respectively. Suitably, the medical support assembly garment 1 is of a water-resistant composition, such as a nylon fabric for bathing, or of a cloth composition for non-bathing activities, such as day and night wearing.

The medical support assembly garment 1 further includes at least one pocket, such as pocket 5*a* or 5*b* shown in phantom, attached to one or both of the inner surfaces 11*a* and 11*b* of the vest 2. Suitably, the medical support assembly garment 1 includes at least two pockets attached to the vest 2, with one pocket, such as pocket 5*a*, attached to the left front portion 4*a* and another, such as pocket 5*b* attached to the right front portion 5*b*, as shown in FIG. 1. Suitably, pockets 5*a* or 5*b* are adjustably or removably attached to the vest, such as via Velcro®. Suitably, each of the pockets 5*a* and 5*b* includes means for opening and closing of the pocket, placed on the edge portions 8*a* and 8*b* of the pocket 5*a* and 5*b* respectively. Suitably, means for opening and closing of the pockets 5*a* and 5*b* includes well known mechanism in art for effectuating closures of openings in clothing items such as zippers, complimental set of buttons and hole, strips of hook and loop material, Velcro® etc.

As shown in FIG. 1, the left front portion 4*a* and the right front portion 4*b* each include an edge portion, such as 6*a* and 6*b* respectively, positioned opposite to each other to define a front opening 7 of the vest 2. Suitably, the vest 2 further comprises means for opening and closing of the front opening 7, placed on the edge portions 6*a* and 6*b*. Suitably, means for opening and closing of the front opening 7 includes well known mechanism in art for effectuating closures of openings in clothing items such as zippers, complimental set of buttons and hole, strips of hook and loop material, Velcro® etc.

Figure 2:
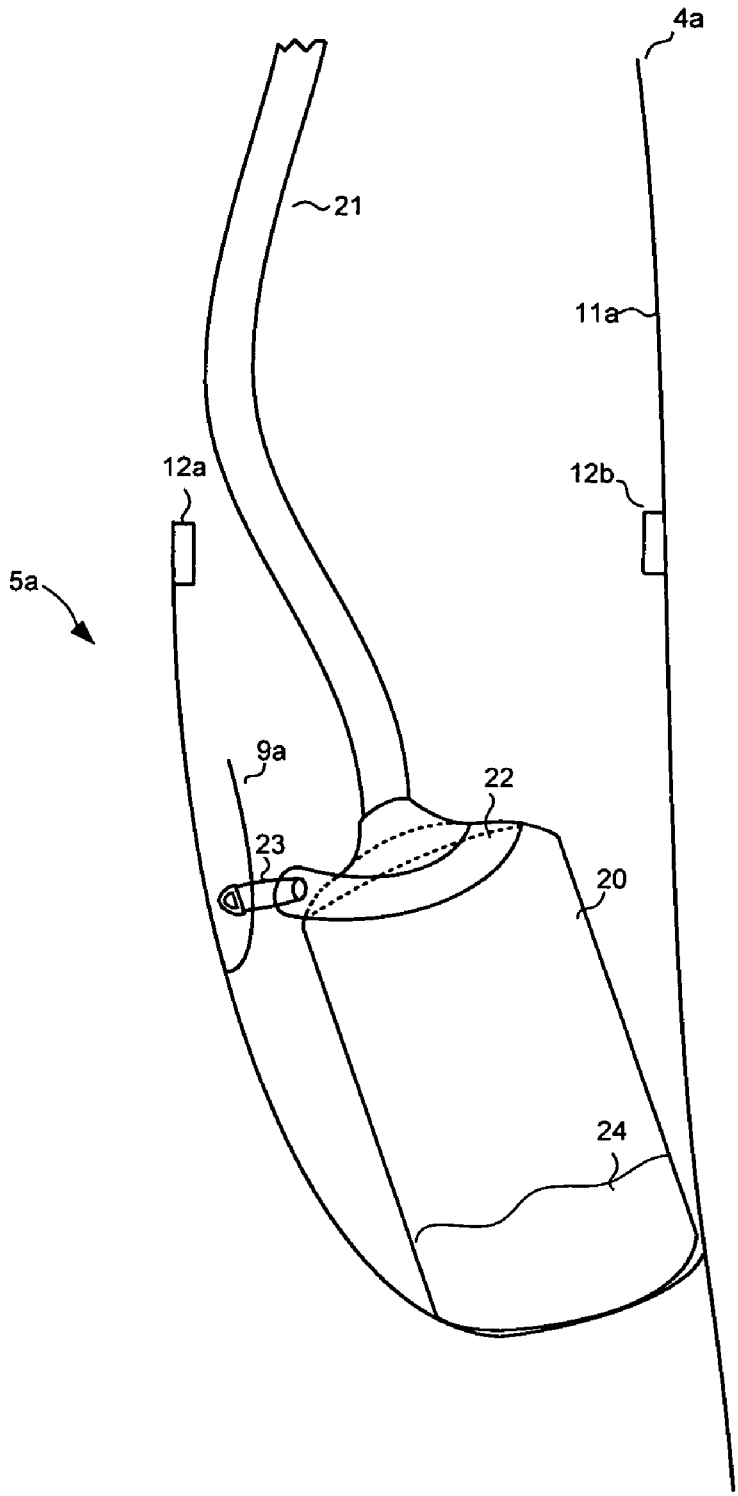
FIG. 2 is a side sectional view of an embodiment of the present invention.

FIG. 2 is a side sectional view of the embodiment of the present invention shown in FIG. 1. For simplicity of illustration, only a cross section in the area of front right portion 4*a* is shown. As shown in FIG. 2, the pocket 5*a* is adapted to support at least one container 20 for storing bodily fluid 24 outputted from the patient, such as post-operative fluids, such as blood or lymph, or other fluids. A drain tube 21 is attached to the container 20 and adapted to transfer the bodily fluid 24 outputted from the patient, such as from the patient's breast (not shown) to the container 20. As shown, the pocket 5*a* comprises the at least one tab portion 9*a* attached to the interior of the pocket for restricting the movement of the drain tube 21 or the container 20 in the pocket 5*a*. Suitably, the drainage bottle 20 is attached to the tab portion 9*a* via a ribbon 22 attached to the drainage bottle and a pin 23, such as safety pin, attaching the ribbon 22 to the tab portion 9*a*.

As previously illustrated in FIG. 1, the pocket 5*a* can be closed along the edge portion 8*a*, such as by complimental Velcro® strips 12*a* and 12*b* as shown in FIG. 2. Suitably, other pockets of vest 2, such as pocket 5*b* are likewise adapted to support at least one container 20 for storing bodily fluid 24 outputted from the patient and at least one tab portion, such as tab portion 9*b* in FIG. 1, for restricting the movement of the drain tube 21 or the container 20 in the pocket 5*b*. Suitably, pocket 5*a* is used for supporting a container 20 for storing bodily fluid 24 outputted from a patient's right breast and pocket 5*b* is used for supporting a container 20 for storing bodily fluid 24 outputted from a patient's left breast.

One advantage of the foregoing feature of the present invention over the prior art is that by placing the pockets 5*a* and 5*b* (and thus the tubes 21 and container 20) on the inner surface of the front portions 4*a* and 4*b* of the vest 2, respectively, outside exposure of the containers 20 and the tubes 21 is reduced, thus reducing the occurrence of impact or their entanglements with external objects in the patient's path, such as door knobs, handles or other protruding objects. In addition, the use of the tab portions 9*a* and 9*b*, reduces the need for attaching the container 20 directly to the patient's garment or clothing such by poking holes via the pin 23, thus increasing the longevity and maintaining structural integrity of the patient's garment or clothing. Furthermore, since the medical support assembly garment 1 is suitably of a water-resistant composition, the patient is no longer required to remove the vest 2 during showering, thus freeing the patient's hand and reducing shower related injuries. The medical support assembly garment 1 can also be suitably made of cloth with pockets 5*a* and 5*b* to hold the container 20 during sleep periods and during activity periods to hold the container 20 centered under the drain incision for proper placement.

Figure 3:
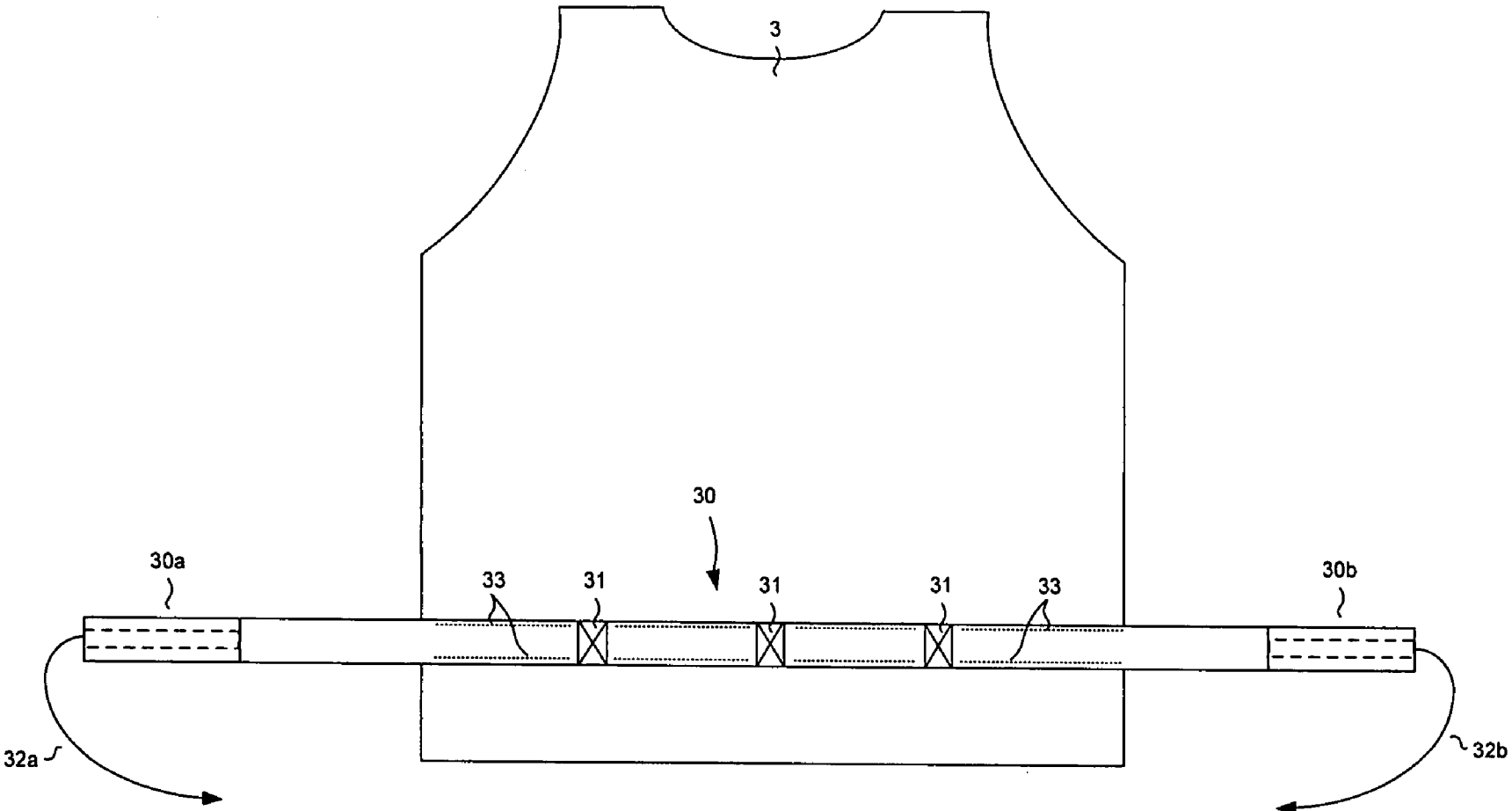
FIG. 3 is another view of an embodiment of the medical support assembly garment of the present invention.

FIG. 3 is a front inside view of the back portion 3 of the medical support assembly garment 1. For case of illustration, the front left and right portions 4*a* and 4*b* are not shown in FIG. 3. In this embodiment of the present invention, the medical support assembly garment 1 further includes a retaining belt assembly 30 attached to the vest 2. As shown in FIG. 3, the retaining belt assembly 30 is attached to the back portion 3 of the interior of the vest 2. As further shown in FIG. 3, the belt assembly 30 includes end portions 30*a* and 30*b* adapted to circumscribe the patient's torso, such as in the direction shown by arrows 32*a* and 32*b* respectively. The end portions 30*a* and 30*b* are then adapted to attach to each other to retain the torso within the vest 2, such as via forming a tied knot or via complimental set of buttons and hole, strips of hook and loop material, Velcro® or other well known mechanism in art. Thus, the end portions 30*a* and 30*h* circumscribe the torso within the vest 2 and attach to each other when the vest is worn to retain the torso within the interior of the vest and, as described in more detail below, secure the vest to the torso to prevent slippage during bathing by the patient. Suitably, the belt assembly 30 is retained by or attached to back portion 3 of the vest, as shown in FIG. 3. Suitably, the belt assembly 30 is retained by the back portion 3 via belt loops 31, or attached to the back portion 3 via sewing 33, or via other means of retaining or attaching fabrics well known in the art.

One advantage of the foregoing feature of the present invention over the prior art is that by using the belt assembly 30 to circumscribe and retain the torso within the vest 2, the medical support assembly garment 1 can be more securely and snugly adjusted to fit a patient's body, thus reducing the occurrence of accidental slippage of the vest 2 from the patient's body. In addition, for activities such as bathing and basin while dressing sutures are present, the belt assembly 30 reduces the occurrence of the entry and accumulation of water and other external fluids into the vest 2 and pocket 5*a* and 5*b*, thus assisting to keep the inside of the vest 2 relatively dry.

It should be noted that the various features of the foregoing embodiments were discussed separately for clarity of description only and they can be incorporated in whole or in part into a single embodiment of the invention having all or some of these features. It should further be noted that the use of the present invention is not limited to breast operations but can be readily used in conjunction with virtually any medical drainage device that is externally attached to a patients body, such as catheters, and any container adapted to receiving the outputs from the drainage devices.

What is claimed is:

1. A medical support assembly garment dimensionally adapted to receive a torso of a patient, the garment comprising:

a vest including a back portion and a left front portion and a right front portion each extending from opposite ends of the back portion and each comprising an inner surface facing the torso, the vest being formed from a water-compatible material for use by the patient for bathing, the vest further comprising:

a retaining belt assembly attached to the back portion of the interior of the vest comprising a first end and a second end, wherein the first and second ends circumscribe the torso within the vest and attach to each other when the vest is worn to retain the torso within the interior of the vest and to secure the vest to the torso to prevent slippage during bathing by the patient;

at least one pocket attached to the inner surface of at least one of the left and the right portions, wherein the packet is adapted to support at least one container for storing bodily fluid outputted from the patient, the container comprising a drain tube attached to the container adapted to transfer the bodily fluid outputted from the patient to the container;

a tab portion attached to the interior of the pocket, the tab portion to be secured to a ribbon of the container by a securing device to restrict movement of the container; and complementary means for opening and closing the pocket located at the opening of the pocket to secure the container and tube within the pocket.

2. The garment of claim 1, wherein the left front portion and the right front portion each comprise an edge portion positioned opposite to each other to define a front opening of the vest, wherein the vest further comprises means for opening and closing of the front opening.

3. The garment of claim 1, further comprising:

a plurality of pockets attached to the vest, wherein at least one pocket is attached to the left front portion and at least one pocket is attached to the right front portion wherein each pocket is adapted to support at least one container storing fluid outputted from the patient.

4. The garment of claim 1, wherein the at least one pocket is adjustably attached to the vest.

5. The garment of claim 1, wherein the at least one pocket is removably attached to the vest.

6. The garment of claim 1, wherein the garment is a post-operative support garment.

* * * * *